United States Patent [19]

Franz et al.

[11] Patent Number: 4,572,048

[45] Date of Patent: Feb. 25, 1986

[54] ELECTRONIC MUSICAL INSTRUMENT

[75] Inventors: Reinhard Franz, Tulpenstrasse 15, D-5401 Emmelshausen; Wilfried Dittmar, Halsenbach, both of Fed. Rep. of Germany; Christian Scheidegger, Buchs, Switzerland; Roland Fröhlich, Leiningen, Fed. Rep. of Germany

[73] Assignee: Reinhard Franz, Emmelshausen, Fed. Rep. of Germany

[21] Appl. No.: 612,533

[22] Filed: May 21, 1984

[30] Foreign Application Priority Data

May 21, 1983 [DE] Fed. Rep. of Germany ..... 3318669

[51] Int. Cl.[4] ..... G10H 1/02

[52] U.S. Cl. ..... 84/1.19; 84/1.01

[58] Field of Search ..... 84/1.01, 1.19, 115

[56] References Cited

U.S. PATENT DOCUMENTS 4,412,470 11/1983 Jones ..... 84/1.01

4,502,359 3/1985 Sano ..... 84/1.19

4,522,099 6/1985 Melsheimer ..... 84/1.01

*Primary Examiner*—William M. Shoop, Jr.

*Assistant Examiner*—Sharon D. Logan

*Attorney, Agent, or Firm*—Peter K. Kontler

[57] ABSTRACT

An electronic musical instrument has input elements such as tone selector keys and control knobs which send input signals representing desired tone parameters to a primary computer. The primary computer, which includes a primary microprocessor and a primary memory, is connected with several voice modules and several effect-producing modules by means of a primary bus. Each voice module has a plurality of tone outputs for generating different tones. The tones for each voice module are produced by a respective subsystem including an auxiliary microprocessor, a clocking device and a digital-analog converter unit which are connected by an auxiliary bus. The auxiliary bus is connected with the primary bus via a bus switch. An auxiliary memory belonging to the subsystem is connected with the bus switch which permits the auxiliary memory to alternately communicate with the primary bus and the auxiliary bus. The subsystem further includes a sequencer which is driven by clocking signals generated by the clocking device. By using an auxiliary microprocessor and an auxiliary memory to create the tones, the workload of the primary microprocessor may be reduced and it becomes possible to generate a relatively large number of acoustically satisfactory tones simultaneously with relatively little added expense.

28 Claims, 4 Drawing Figures

1
2
PAN 1
PAN 2
PoT
OM
UM
PD
PB
HB
MC
ROM
CPU
RAM
3
V1
V2
V3
E1
E2
E3
D
IF
A
AB
4
5
C
L2
L1
KH

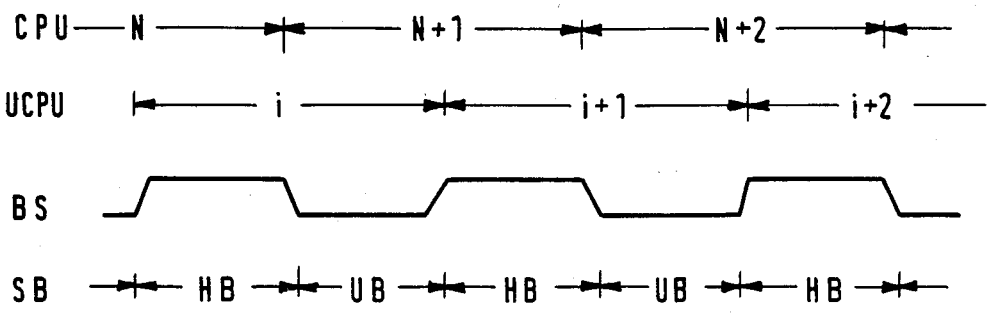
Fig.3
Fig.4
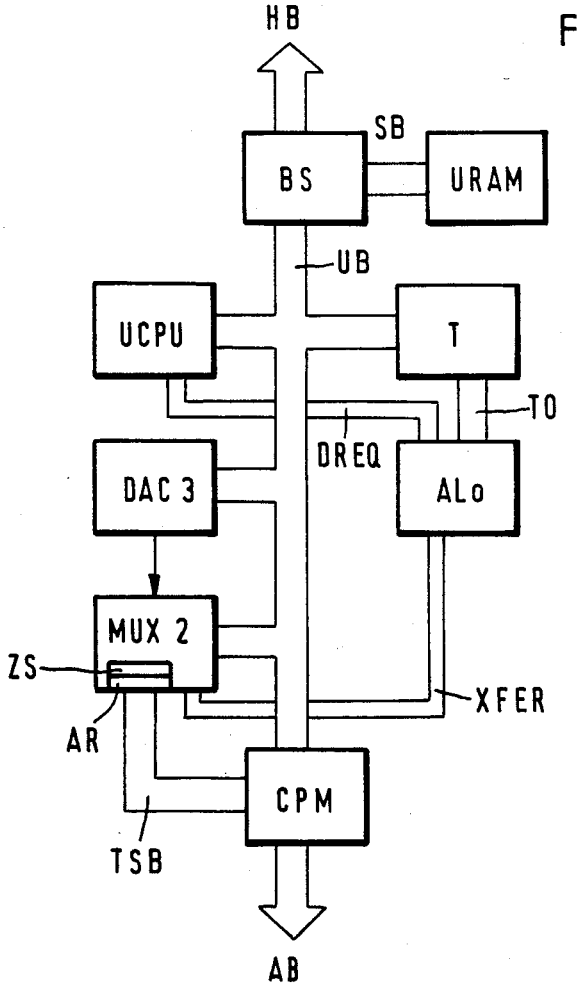

ELECTRONIC MUSICAL INSTRUMENT

BACKGROUND OF THE INVENTION

The invention relates generally to an electronic musical instrument.

More particularly, the invention relates to an electronic musical instrument of the type having keys which are manipulated in order to generate tones.

A known electronic musical instrument has a main or primary system which includes a main or primary bus as well as a main or primary computer connected with the bus. The primary computer comprises a microprocessor and a memory. The primary bus has various conductors for the transmission of tone information, addressing signals and control signals. One or more voice modules are connected with the primary computer via the primary bus. The instrument has input means such as keys for the generation of tones and digital and/or analog control elements. The input means emits input signals representing the parameters of desired tones and these input signals are delivered to the primary computer. The voice module or modules generate various tones depending upon which elements of the input means are activated.

In one conventional electronic musical instrument of this type, the formation of a tone by a voice module involves a point-by-point combination of stored digital data to generate a digital signal which is subsequently converted to an analog signal. The digital data are either stored in the memory as a table or are derived from calculations performed by the computer. If a large number of tones, e.g. in excess of ten tones, are to be generated simultaneously, the memory becomes very large and the processing speed of the microprocessor is no longer sufficient for all of the tones to be acoustically correct.

OBJECTS AND SUMMARY OF THE INVENTION

It is an object of the invention to provide an electronic musical instrument which is capable of producing a relatively large number of acoustically correct tones simultaneously.

Another object of the invention is to provide an electronic musical instrument of the type described above which, with relatively little added expense, is capable of producing a relatively large number of acoustically correct tones simultaneously.

The preceding objects, as well as others which will become apparent as the description proceeds, are achieved by the invention.

One aspect of the invention resides in an electronic musical instrument which comprises the following:

(a) Main or primary computer means. The primary computer means may constitute part of a main or primary system which, in addition to the primary computer means, includes a main or primary bus connected with the primary computer means. The primary computer means preferably comprises a main or primary memory as well as a main or primary microprocessor. The primary bus may include one or more conductors for the transmission of tone information, one or more conductors for the transmission of addressing signals, and one or more conductors for the transmission of control signals.

(b) Input means for supplying input signals representing desired tone parameters to the primary computer means. The input means may include digital control elements, analog control elements and/or keys which are manipulated in order to produce desired tones.

(c) Voice or tone module means connected with and operative to generate tones in response to the arrival of the input signals at the primary computer means. The voice module means includes at least one voice or tone module having a plurality of tone outputs. The voice module further has auxiliary computer means designed to store digital data representing tones to be generated, and at least one digital-analog converter unit connected with the auxiliary computer means and including at least one digital-analog converter, and a plurality of analog outputs each of which is arranged to communicate with a respective tone output. The voice module also has a clocking device for generating clocking signals, and a sequencer responsive to the clocking signals and operative to effect transfer of the digital tone data to the digital-analog converter unit and to regulate the appearance of analog output signals corresponding to the digital tone data at the analog outputs.

The voice module means may be connected with the primary computer means via the primary bus.

The auxiliary computer means, digital-analog converter unit, clocking device and sequencer may all constitute part of a subsystem which belongs to the voice module and further includes an auxiliary bus connecting the auxiliary computer means with the digital-analog converter unit, clocking device and sequencer. Similarly to the primary bus, the auxiliary bus may comprise one or more conductors for the transmission of tone information, one or more conductors for the transmission of addressing signals, and one or more conductors for the transmission of control signals. The auxiliary computer means preferably includes an auxiliary memory as well as an auxiliary microprocessor.

It is preferred for the clocking device to be capable of generating clocking signals at different frequencies. Advantageously, the clocking device is designed in such a manner that, for each tone to be generated by the voice module, the clocking device can generate clocking signals at a frequency exceeding the frequency of the tone. Preferably, the clocking frequency for each tone is a multiple of the tone frequency.

The digital-analog converter unit may have an output register corresponding to each of the analog outputs.

The sequencer may be designed to generate transfer signals for effecting transfer of the digital tone data from the auxiliary computer means to the digital-analog converter unit. The sequencer may be further designed to generate control signals for effecting the appearance of analog output signals at the analog outputs.

The auxiliary computer means or computer enables the primary computer means or computer to be effectively relieved of a significant part of its workload. All that is required of the primary computer insofar as the actual production of tones is concerned is to calculate new tone parameters when the input data are changed and to transfer these parameters to the auxiliary memory. The primary computer thus becomes available for other functions. For example, the primary computer may cyclically sample peripheral units. The added expense for the auxiliary computer may be small since it is not necessary to impose strict requirements on either the auxiliary microprocessor or the auxiliary memory. Moreover, the additional cost involved in employing subsystems in accordance with the invention may be held down due to the fact that a single auxiliary computer may be used to produce more than one tone.

According to one embodiment of the invention, a voice module has an auxiliary computer capable of producing four tones or voices with a total of eight tone signals. The instrument as a hole has four such voice modules. By employing a sequencer in conjunction with a clocking device capable of generating an independent series of clocking signals for each tone or voice, the individual tones may be formed independently of one another.

The signals or commands which the sequencer issues in order to effect the transfer of digital tone data from the auxiliary memory to the digital-analog converter may be sent directly to the auxiliary microprocessor, that is, the sequencer may operate upon the microprocessor directly. It is preferred, however, to provide the voice module with a separate memory access device which receives the transfer signals from the sequencer and retrieves the digital tone data from the auxiliary memory in response to these signals. The reason is that a memory access device can retrieve the digital tone data more rapidly than a microprocessor. Consequently, the periods for which the work of the auxiliary microprocessor is interrupted for the purpose of data retrieval may be shortened by the use of a separate memory access device.

The digital-analog converter may have a single channel. The digital-analog converter unit then includes a multiplexer which is disposed between the digital-analog converter and the analog outputs of the digital-analog converter unit. The output registers of the digital-analog converter unit may here constitute part of the analog outputs.

It is also possible for the digital-analog converter to have a number of channels equal to the number of tone outputs of the voice module. The control signals or commands which the sequencer issues to regulate the appearance of analog output signals at the analog outputs then function to address the channels.

The sequencer may be provided with a delay or priority circuit which prevents two or more signals for the transfer of digital tone data to the digital-analog converter unit from being generated simultaneously. The delay circuit functions to retard one or more signals of a group so that these signals are generated sequentially rather than simultaneously. An intermediate memory is here disposed between each analog output and the auxiliary memory. The intermediate memories serve to temporarily store tone information between the time that this information is retrieved from the auxiliary memory and the time that the information is forwarded to the analog outputs. The control signals which the sequencer issues to regulate the appearance of analog output signals at the analog outputs operate upon the intermediate memories to cause the tone information stored therein to be forwarded to the analog outputs. The sequencer and the clocking device are coordinated in such a manner that the control signals coincide with the clocking signals. This embodiment of the invention makes it possible to transfer tone information for different analog outputs from the auxiliary memory to the digital-analog converter unit in sequence even though the tone information must enter the respective analog outputs simultaneously in order to avoid interference effects. Thus, the intermediate memories function to compensate for the time intervals between the retrieval of tone information for different analog outputs from the auxiliary memory.

The digital-analog converter may be designed as a multiplying converter which is capable of multiplying tone signals or curves corresponding to the digital tone data by predetermined multiplication factors. The multiplication factors may be represented by analog envelope signals or curves which are transmitted to the digital-analog converter unit separately from the digital tone data. The analog envelope signals may be derived from digital envelope data and, to this end, the voice module may be provided with a second digital-analog converter unit. The second digital-analog converter unit, which is preferably connected to the auxiliary bus, comprises a second digital-analog converter as well as registers arranged to receive the analog envelope signals produced by the second digital-analog converter. Each of the analog outputs of the first digital-analog converter unit is connected with one of the registers of the second digital-analog converter unit. By virtue of the fact that the tone signals and the envelope signals are produced separately and then multiplied with one another, the amount of computational work which need be performed in the auxiliary microprocessor may be reduced.

The second digital-analog converter may have a single channel. The second digital-analog converter unit then includes a multiplexer which is interposed between the second digital-analog converter and the envelope signal registers. The multiplexer functions to distribute the analog envelope signals among the registers.

Instead of a single channel, the second digital-analog converter may have a channel for each of the analog outputs of the first digital-analog converter unit. The channels of the second digital-analog converter are here arranged to be addressed by means of appropriate addressing signals.

It is of advantage for the number of tone outputs of the voice module to be at least double the number of clocking channels of the clocking device and for the first digital-analog converter unit to be provided with a plurality of analog outputs for each of the tone output. By arranging the clocking device so that the clocking signals for a given tone regulate the signals for some or all of the corresponding analog outputs, it becomes possible, in a relatively simple fashion, to produce very complicated tones which could otherwise be generated only at considerable expense.

A bus switch may be provided in order to alternately connect the auxiliary memory with the primary and auxiliary busses. The bus switch is preferably designed to permit bidirectional data flow or exchange between the primary system and the subsystem. Since the bus switch enables the auxiliary memory to alternately communicate with the primary bus and the auxiliary bus, data which are stored by the primary system may be read by the subsystem while, on the other hand, return data which are stored by the subsystem may be read by the primary system. Due to the fact that the primary and auxiliary memories as well as the bus switch may operate at high frequencies, it is even possible to sequentially connect the auxiliary memory with both the primary bus and the auxiliary bus during each cycle of the microprocessors.

The analog outputs of the first digital-analog converter unit may all be connected with an audio line or table leading out of the voice module. An output switch may be disposed between each analog output and the audio line. The output switches, which may constitute part of the respective tone outputs, permit the corresponding analog outputs to be cut off from the audio line entirely. This enables background noise to be reduced or eliminated. The output switches may also be employed to establish communication between the respective analog outputs and a selected one of several audio lines. This may be desirable, for example, if the musical instrument has various effect-producing modules which are connected with the tone outputs by respective audio lines and the signals issuing from the tone outputs are to be further processed in one of the effect-producing modules.

The novel features which are considered as characteristic of the invention are set forth in particular in the appended claims. The improved musical instrument itself, however, both as to its construction and its mode of operation, together with additional features and advantages thereof, will be best understood upon perusal of the following detailed description of certain specific embodiments with reference to the accompanying drawings.

BRIEF DESCRIPTION OF THE DRAWINGS

FIG. 3 is a timing diagram for a bus switch constituting part of the voice module of FIG. 2; and FIG. 4 is a block diagram of another embodiment of a voice module in accordance with the invention.

DESCRIPTION OF THE PREFERRED EMBODIMENTS

Figure 1:
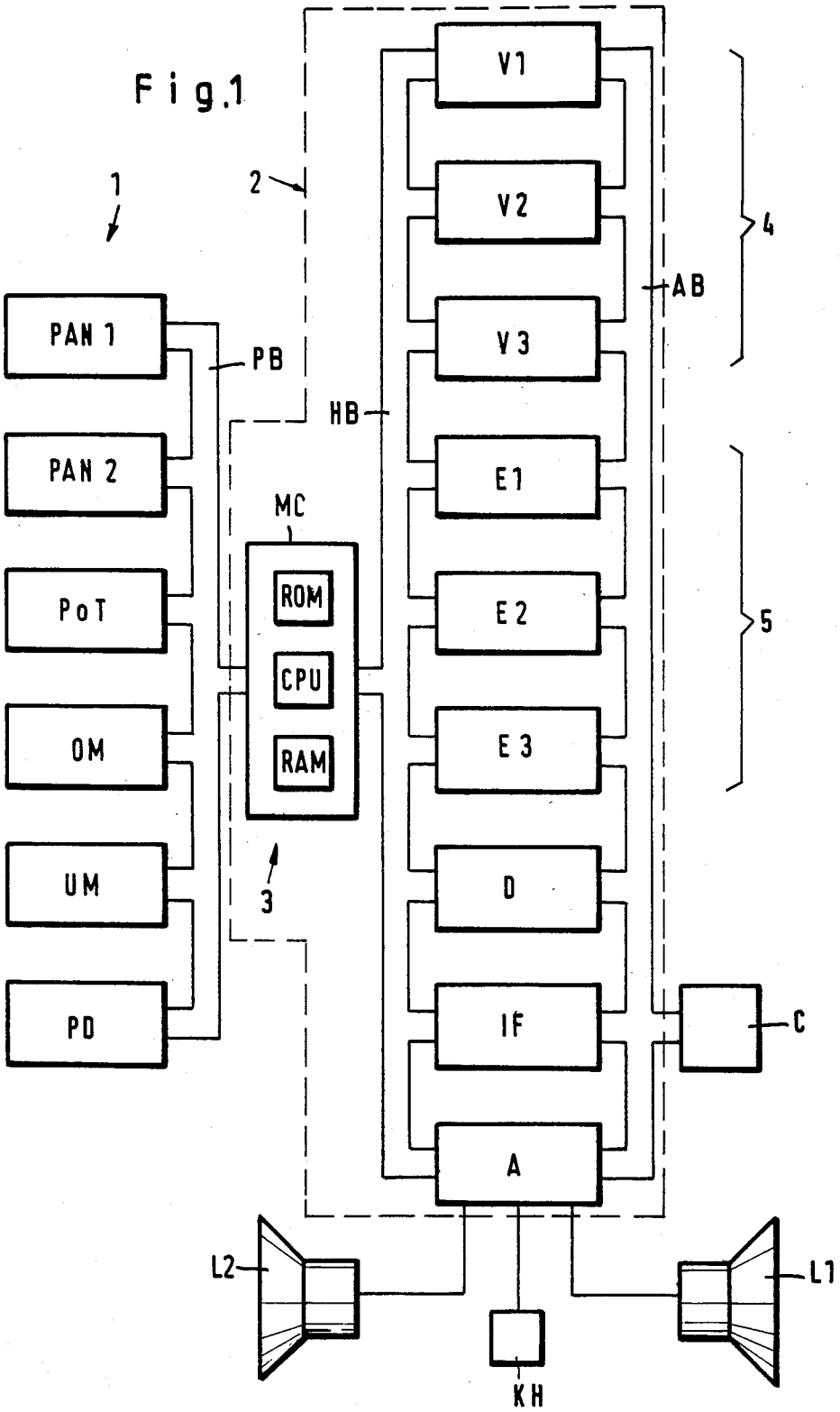
FIG. 1 is a block diagram of an electronic musical instrument according to the invention having at least one keyboard.

FIG. 1 illustrates an electronic musical instrument according to the invention. The instrument is here assumed to be an electronic organ. The organ includes a peripheral or external portion 1 made up of several assemblies which are located essentially at the front of the organ. The organ further includes a functional portion 2 which is located virtually entirely inside the housing of the organ.

In the illustrated embodiment, the peripheral portion 1 has a control and indicator panel or keyboard PAN1 which contains control keys or knobs, as well as associated indicators, used for operation of the organ. For example, the control keys may operate stop switches which function to activate and deactivate filter groups, effects, tone channels, and so on.

The organ shown in FIG. 1 also has a second control and indicator keyboard or panel PAN2 which contains digital input elements in the form of control keys or knobs as well as corresponding indicators. The control and indicator panel PAN2 controls a rhythym-producing unit and associated automatic devices.

The illustrated organ further has a control panel POT which contains infinitely variable, analog input or control elements, e.g. potentiometers. The control panel POT may, for instance, be used to operate sliding controls for sinusoidal variation of volume, tone pitch regulators, and so on.

The illustrated embodiment of the organ is additionally provided with an upper manuel OM, a lower manuel UM and a pedalboard PD. The upper manuel OM, lower manuel UM and pedalboard PD are each made up of keys which are used to generate different tones.

The control and indicator panel PAN1; control and indicator panel PAN2; control panel POT; upper manual OM; lower manual UM; and pedalboard PD together constitute the peripheral portion 1 of the organ of FIG. 1.

The control and indicator panel PAN1; control and indicator panel PAN2; control panel POT; upper manual OM; lower manual UM; and pedalboard PD are connected with a main or primary system 3 via a peripheral bus PB. The peripheral bus PB has conductors for the transmission of tone information, the transmission of addressing signals and the transmission of control signals. The primary system 3, which constitutes part of the functional portion 2 of the organ, comprises a main or primary computer MC. The primary computer MC in turn, includes a primary or main microprocessor CPU, a primary or main memory ROM for the storage of programs, and a primary or main memory RAM for the storage of data other than programs. The primary computer MC cyclically samples the various input elements of the peripheral portion 1 of the organ, i.e. the control keys of the control and indicator panel PAN1; the digital control elements of the control and indicator panel PAN2; the analog control elements of the control panel POT; and the tone selector keys of the upper manual OM, the lower manual UM and the pedalboard PD. The conditions of the input elements as sensed by the primary computer MC are stored in the primary memory RAM. In addition to sampling the input elements, the primary computer MC also controls the indicators of the peripheral portion 1.

The primary system 3 has a primary or main bus HB which, like the peripheral bus PB contains conductors for the transmission of tone data, the transmission of addressing signals, and the transmission of control signals. A voice or tone module assembly 4 is connected with the primary bus HB and includes several tone or voice modules V1, V2 and V3. The voice modudes V1, V2, V3 generate tones under the control of the primary computer MC when the selector keys of the upper manual OM, the lower manual UM and/or the pedalboard PD are activated. The tones produced upon activation of the tone selector keys depend upon which of the control elements of the control and indicator panel PAN1, the control and indicatpr panel PAN2, and the control panel POT are in operation at the same time. The tones produced by the voice modules V1, V2, V3 are delivered to an audio bus or line AB.

An effect-producing assembly 5 is also connected to the primary bus HB. The effect-producing assembly 5 comprises several effect-producing modules E1, E2 and E3. The tones generated by the voice modules V1, V2, V3 undergo further processing in the effect-producing modules E1, E2, E3.

A rhythym-producing module D is further connected with the primary bus HB. The rhythym-producing module D transmits audio signals representing rhythym effects to the audio bus AB.

The primary bus HB is additionally connected with an interface module IF. The interface module IF enables bidirectional communication to be established between the primary bus HB and the audio bus AB.

In the illustrated embodiment, an amplifying module A is finally connected with the primary bus HB. The amplifying module A leads to loudspeakers L1 and L2 as well as to a headphone connection KH.

The voice modules V1, V2, V3; the effect-producing modules E1, E2, E3; the rhythym-producing module D; the interface module IF; the amplifying module A; the primary bus HB; and the audio bus AB all constitute part of the functional portion 2 of the organ.

The audio bus AB is also connected with a mounding unit C. The mounting unit C is designed to permit sound carriers, e.g. cassettes, to be coupled to the audio bus AB.

Figure 2:
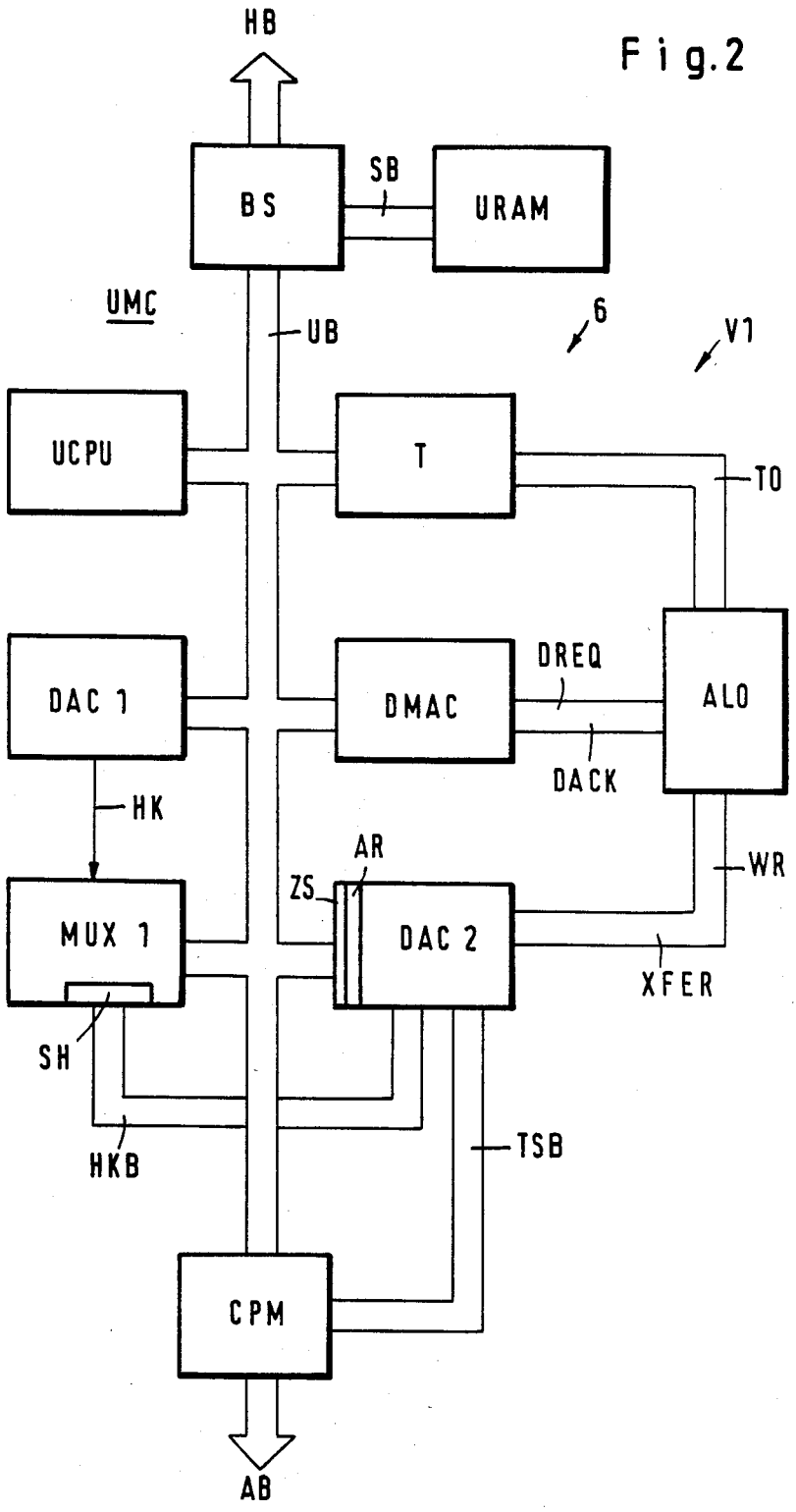
FIG. 2 is a block diagram of a voice module of the musical instrument of FIG. 1.

FIG. 2 illustrates the structure of the voice module V1. It will be understood that the structures of the voice modules V2, V3 may be the same as that of the voice module V1. The voice module V1 is designed to produce four different tones simultaneously. Each tone generated by the voice module V1 is composed of two tone curves and two envelopes. To this end, the voice module V1 has eight output registers AR.

The voice module V1 has a subsystem 6 which forms the tones emitted by the voice module V1. The subsystem 6 has an auxiliary computer UMC which, in turn, includes an auxiliary memory URAM and an auxiliary microprocessor UCPU. The subsystem 6 further has an auxiliary bus UB which is connected with the auxiliary microprocessor UCPU. A bus switch BS connects the auxiliary bus UB with the primary bus HB. A memory bus SB leads from the bus switch BS to the auxiliary memory URAM.

The bus switch BS is designed to alternately establish communication between the memory bus SB and the primary bus HB, and between the memory bus SB and the auxiliary bus UB. To this end, the switching frequency of the bus switch BS is double the clocking frequency of the primary computer MC and the auxiliary computer UMC. The bus switch BS is designed so that the subsystem 6 can receive data from the primary system 3 while, conversely, the primary system 3 can receive data from the subsystem 6, i.e. the bus switch BS is designed to permit bidirectional data flow between the primary system 3 and the subsystem 6.

The primary system 3 loads the program for the subsystem 6, as well as parameters for the four tones to be generated by the voice module V1, into the auxiliary memory URAM.

In addition to the computer UMC, a clocking device or time T capable of issuing clocking signals at a plurality of frequencies is connected to the auxiliary bus UB as is a memory access device or circuit DMAC. Also connected to the auxiliary bus UB are a 12-bit, single-channel digital-analog converter DAC1 and an 8-channel multiplexer MUX1 having eight registers SH for envelope signals or curves. The registers SH are here in the form of sample-and-hold devices. The auxiliary bus UB is further connected with a doubly buffered, 8-bit, 8-channel digital-analog converter DAC2 amd an assembly of tone output switches CPM arranged in the form of an intersection point matrix. A sequence or sequence control circuit ALO is connected with the clocking device T, the memory access device DMAC and the digital-analog converter DAC2.

The output registers AR, which are digital output registers, are respectively associated or connected in circuit with different ones of the channels of the digital-analog converter DAC2. The digital-analog converter DAC2 and output registers AR together constitute a first digital-analog converter unit. The digital-analog converter unit DAC2, AR has eight analog outputs for analog output signals with each analog output corresponding to one of the channels of the digital-analog converter DAC2.

The analog outputs of the digital-analog converter unit DAC2, AR are connected with the intersection point matrix CPM via an 8-channel tone signal bus TSB. Each of the channels of the tone signal bus TSB corresponds to one of the channels of the digital-analog converter DAC2 and connects the respective analog output with an output switch of the intersection point matrix which functions to regulate the corresponding tone. The output switches of the intersection point matrix CPM constitute or constitute part of tone outputs of the voice module V1.

The single-channel digital-analog converter DAC1 is connected with the multiplexer MUX1 by a conductor HK. The digital-analog converter DAC1, the conductor HK, the multiplexer MUX1 and the envelope registers SH together constitute a second digital-analog converter unit.

An envelope signal bus HKB connects the envelope registers SH with the digital-analog converter unit DAC2, AR. The envelope signal bus HKB has eight channels each of which connects one of the envelope registers SH with a respective channel of the digital-analog converter unit DAC2, AR.

An intermediate memory ZS is associated or connected in circuit with each of the output, registers AR of the digital-analog converter unit DAC2, AR. The intermediate memories ZS are so arranged relative to the output registers AR that data transmitted to the digital-analog converter DAC2 via the auxiliary bus UB must pass through the intermediate memories Z before entering the output registers AR.

Similarly to te peripheral bus PB and the primary bus HB, the auxiliary bus UB has conductors for the transmission of tone information, the transmission of addressing signals, and the transmission of control signals.

The auxiliary microprocessor UCPU initiates calculation of the envelopes and also serves to program the clocking device T, the memory access device DMAC, and the intersection point matrix CPM.

The clocking device T, which is here designed such that the number oftone outputs of the voice module V1 is double the number of clocking channels, determines the frequency of the four tones to be generated by the voice module V1 as well as the repeat frequency with which the envelopes are recalculated. The clocking device T generates four independent series of clocking signals TO, one for each tone to be generated by the voice module V1. The frequency of the clocking signals TO for each tone is a multiple of the frequency of the respective tone.

The memory access device DMAC repeatedly retrieves digital tone data for the four tones from the auxiliary memory URAM in response to the clocking signals TO. The digit data representing the envelopes for the four tones are converted into analog envelope signals in the digital-analog converter DAC1. The analog envelope signals are delivered to the multiplexer MUX1 via the conductor HK. The multiplexer MUX1 distributes the analog envelope signals to the respective envelope registers SH. The eight analog envelope signals, which may differ from one another, are then transmitted to the corresponding channels of the digital-analog converter DAC2 via the envelope signal bus HKB.

Through the agency of the memory access device DMAC, the digital-analog converter DAC2 receives digital tone data for the generation of eight tone curves from a table stored in the auxiliary memory URAM. The digital tone data are transmitted through the intermediate memories ZS to the digital output registers AR along eight channels and multiplied by the respective envelope signals. To this end, the digital-analog converter DAC2 is designed as a multiplying converter. The resulting analog output signals are forwarded to the corresponding channels of the 8-channel tone signal bus TSB.

The audio bus AB has multiple channels and the intersection point matrix CPM either sends a respective analog output signal to one or more of the channels of the audio bus AB as a tone or cuts off the signal from the audio bus AB.

The operation of the electronic organ of FIGS. 1 and 2 is as follows:

When the organ is activated, the program for the auxiliary microprocessor UCPU is transmitted through the primary bus HB and loaded into the auxiliary memory URAM via the bus switch BS. Since the program is determined by the primary system 3, the program may be readily changed. By switching off a reset signal, the auxiliary microprocessor UCPU is started and activates the various components of the subsystem 6 such as the clocking device T, the intersection point matrix CPM, the memory access device DMAC, and so on.

As soon as a tone is to sound, the primary system 3 loads parameters, e.g. approximately 170 bytes, into the auxiliary memory URAM and then sends a start command to the latter. This occurs regardless of whether the tone is generated by a selector key of the upper manual OM, the lower manual UM or the pedalboard PD, or by one of the automatic devices incorporated in the organ. The auxiliary microprocessor UCPU can read the start command after the next switchover of the bus switch BS and thereupon generates the appropriate tone. This is achieved in that the auxiliary microprocessor UCPU sets the clocking device T, activates the memory access device DMAC, switches the intersection point matrix CPM to the appropriate channel of the audio bus AB, and calculates the envelopes as well as forwarding the same.

The clocking device T transmits clocking signals TO for the selected tone to the sequencer ALO at a frequency which is a multiple of the frequency of the desired tone. The sequencer ALO issues a transfer signal DREQ to the memory access device DMAC. In response to the transfer signal DREQ, the memory access device DMAC retrieves from the auxiliary memory URAM the digital tone data necessary to construct one of the tone curves for the selected tone. As soon as this occurs, an acknowledgement signal DACK is sent to the sequencer ALO by the memory access device DMAC. The sequencer ALO then issues an enter signal WR to the intermediate memory ZS which is in circuit with that channel of the digital-analog converter unit DAC2, AR corresponding to the tone curve to be constructed.

The sequencer ALO is provided with a delay circuit. The delay circuit functions to delayed the transfer signal DREQ and the corresponding enter signal WR for the second tone curve of the selected tone by one operating cycle relative to the transfer signal DREQ and the enter signal WR for the first tone curve. Thus, the digital tone data retrieved from the auxiliary memory URAM by the same clocking signal TO are entered in the respective intermediate memories ZS associated with the corresponding channels of the digital-analog converter unit DAC2, AR at different instants.

Upon issuance of a control signal XFER by the sequencer ALO, the digital tone data stored in the respective intermedoate memories ZS are transferred to the corresponding digital output registers AR. The clocking device T and sequencer ALO are synchronized with one another in such a manner that the control signal XFER coincides with a clocking signal TO, that is, the control signal XFER is issued at the same instant as a clocking signal TO. Consequently, the digital tone data entered into the respective intermediate memories ZS at different instants are transferred into the corresponding output registers AR simultaneously. Upon transfer into the output registers AR, the digital tone data are converted into analog signals which are forwarded to the tone signal bus TSB. The same time differential between transfer signals DREQ as described above arises also when the clocking signals TO for two different tones attempt to occur simultaneously.

The digital-analog converter DAC1 constructs the envelopes for the different tone curves from digital data calculated in the subsystem 6. The construction of the envelopes proceeds according to a time multiplex procedure and the analog signals representing the envelopes, which are forwarded to the multiplexer MUX1 via the single channel defined by the conductor HK, are distributed among the envelope registers SH by the multiplexer MUX1. The analog envelope signals formed in this manner serve as multiplication factors for the signals which are issued by the digital output registers AR and represent the tone curves.

Since two tone curves and two envelopes are available for each tone to be generated by the voice module V1, extremely complicated sounds may be produced using the two tone curves constituting the components of each tone. For example, it is possible to create a sound which contains both a sinusoidal component and a percussive component or a sound simulating a piano plus strings. It is further possible to generate variable sounds such as, for instance, a guitar played with a string tone plus the tone created by the use of a plectrum or, in the case of a flute-like instrument, a sound made up of a sinusoidal tone and background noise or, as a further example, a beat produced by amplitude modulation of the two tone curves of a tone in an opposite sense.

If all tone outputs of each voice module V1, V2, V3 are occupied and a new tone is to be generated, one of the currently running tones must be terminated. To this end, the auxiliary microprocessor UCPU enters a busy signal for each tone in the auxiliary memory URAM where it can be retrieved by the primary microprocessor CPU. Each busy signal has a magnitude corresponding to the instantaneous volume of the respective tone and thus indicates the significance of the tone in the overall sound. If a tone is percussive, it dies out on its own and the subsystem 6 describes this by assigning a zero busy signal to the tone. By sampling the busy signals of the subsystems 6 of all the voice modules V1, V2, V3, the primary system 3 can when a new tone is to be generated, select a voice module V1, V2, V3 which is not fully occupied. If all tone outputs are occupied at the moment, the primary system 3 searches for the tone output having the busy signal with the smallest magnitude and issues an interrupt command for this tone output. The auxiliary microprocessor UCPU reads the interrupt command and interrupts the respective tone.

This causes the corresponding busy signal to go to zero. The primary system 3 can now start the new tone.

When a tone is to be interrupted, the primary computer CPU checks whether this tone is still running in the subsystem 6. To this end, the primary computer CPU determines whether the tone is percussive. If the tone is not percussive, the primary computer CPU establishes whether or not the tone has already been interrupted. On the other hand, if the tone is percussive, the primary computer CPU establishes whether or not the tone has died out completely. Should the tone still be running, the primary computer CPU enters a clear command for this tone, if necessary, in the auxiliary memory URAM. The subsystem 6 then goes into a clear condition with respect to the calculation of the envelopes for the respective tone. The clear condition, during which the envelopes die out, lasts for a time interval which depends upon the form of the envelopes. Once the envelopes have died out completely, the subsystem 6 generates a zero busy signal to indicate that the respective tone output is free.

For each tone being generated at a particular instant, the primary system 3, in addition to its other functions, enters data relating to tone volume, ripple adjustments and, where applicable, other parameters which may change throughout the duration of a tone, into specific addresses of the auxiliary memory URAM.

The output switches arranged in the form of the intersection point matrix CPM function to direct the tones generated by the voice module V1 to specific channels of the audio bus AB. Some or all of the channels of the audio bus AB may lead to the effect-producing modules E1, E2, D3 so that the tones may undergo further processing in the effect-producing modules E1, E2, E3. The channel of the audio bus AB to which a particular tone is directed depends upon the type of tone involved. The output switches of the intersection point matrix CPM also serve to cut off unoccupied channels of the voice module V1 from the audio bus AB entirely. This enables interference signals to be supressed.

The operation of the bus switch BS is illustrated in FIG. 3. The first or uppermost line shows the cycles M, N+1, N+2, etc. of the primary microprocessor CPU while the second line shows the cycles i, i+1, i+2, etc. of the auxiliary microprocessor UCPU. The cycles of the auxiliary microprocessor UCPU have the same length as those of the primary microprocessor CPU but are shifted relative to the cycles of the primary microprocessor CPU by one-half cycle. The third line in FIG. 3 represents the switching signals or the condition of the bus switch BS. The fourth line indicates the lengths of time for which the memory bus SB is in communication with the primary bus HB and with the auxiliary bus UB. The memory bus SB is always in communication with the primary bus HB during the second half of the cycle of the primary computer CPU. Similarly, the memory bus SB is always in communication with the auxiliary bus UB during the second half of the cycle of the auxiliary microprocessor UCPU. As a result, each of the microprocessors CPU and UCPU can read the auxiliary memory RAM and enter data therein as if the auxiliary memory URAM were normally in communication with the corresponding bus HB or UB. Since the auxiliary memory URAM operates more rapidly than the microprocessors CPU and UCPU, it is acceptable for the auxiliary memory URAM to communicate with the microprocessors CPU and UCPU during only a portion of the respective cycles.

FIG. 4 shows another embodiment of a voice module. In FIG. 4, the same reference characters as in FIG. 2 have been used to identify similar components.

The voice module of FIG. 4 differs from that of FIG. 2 in that the memory access device DMAC has been eliminated. The sequencer ALO in FIG. 4 operates directly upon the auxiliary microprocessor UCPU. When the sequencer ALO issues a transfer signal DREQ, the background program of the microprocessor UCPU is interrupted and a transfer program is initiated.

Another difference between the voice module of FIG. 4 and that of FIG. 2 resides in that the tone curves and envelopes are not separately constructed in FIG. 4. To this end, the first digital-analog converter unit DAC2, AR and second digital-analog converter unit DAC1, HK, MUX1, SH of FIG. 2 are replaced by a digital-analog converter unit DAC3, MUX2, ZS, AR. The digital-analog converter unit DAC3, MUX2, ZS, AR includes a single-channel digital-analog converter DAC3 as well as a multiplexer MUX2 which is connectedwith the digital-analog converter DAC3 by a conductor. The digital-analog converter unit DAC3, MUX2, ZS, AR further comprises eight output registers AR and eight corresponding intermediate memories ZS. The output registers AR at least in part constitute analog outputs of the digital-analog converter unit DAC3, MUX2, ZS, AR.

In the voice module of FIG. 4, the digital tone data for the outgoing tones are obtained by calculation and entered in the single-channel digital-analog converter DAC3. Consequently, the outputs of the multiplexer MUX2 which receives the analog signals derived from the digital tone data may be directly connected, via the intermediate memories ZS, with the output registers AR which, in turn, are connected with the intersection point matrix CPM by means of the tone signal bus TSB. The intermediate memories ZS temporarily store the analog signals derived from the digital tone data before these are transferred to the output registers AR. When a control signal XFER, which coincides with a clocking signal TO, is issued by the sequencer ALO, the analog signals for a given tone are transferred to the respective output registers AR simultaneously even though the corresponding digital tone data were previously processed sequentially in the digital-analog converter DAC3.

Conventional components may be used for all elements such as the primary microprocessor CPU; the primary program memory ROM; the primary memory RAM for data other than program; the auxiliary microprocessor UCPU; the auxiliary memory URAM; the bus switch BS; the multiple frequency clocking device T; the memory access device DMAC; the sequencer ALO; the multiplexer MUX1; the multiplexer MUX2; the intersection point matrix CPM; the digital-analog converter DAC1; the digital-analog converter DAC2; and the digital-analog converter DAC3.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. An electronic musical instrument comprising:
(a) primary computer means;
(b) input means for supplying input signals representing desired tone parameters to said primary computer means; and
(c) voice module means connected with and operative to generate tones in response to the arrival of said input signals at said primary computer means, said voice module means including at least one voice module having a plurality of tone outputs, and said one voice module further having auxiliary computer means designed to store digital data representing tones to be generated, and at least one digital-analog converter unit connected with said auxiliary computer means and including at least one digital-analog converter, and a plurality of analog outputs each of which is arranged to communicate with a respective tone output, said one voice module also having a clocking device for generating clocking signals, and a sequencer responsive to said clocking signals and operative to effect transfer of said digital tone data to said one digital-analog converter unit and to regulate the appearance of analog output signals corresponding to said digital tone data at said analog outputs.

2. The instrument of claim 1, wherein said sequencer is designed to generate transfer signals for effecting transfer of said digital tone data to said one digital-analog converter unit, and control signals for effecting the appearance of said analog output signals at said analog outputs.

3. The instrument of claim 1, said one voice module comprising an auxiliary bus connecting said auxiliary computer means with said one digital-analog converter unit, said clocking device, said sequencer and said tone outputs; and wherein said auxiliary bus includes at least one conductor for the transmission of tone information, at least one conductor for the transmission of addressing signals, and at least one conductor for the transmission of control signals.

4. The instrument of claim 1, wherein said auxiliary computer means comprises an auxiliary microprocessor and an auxiliary memory.

5. The instrument of claim 1, wherein said clocking device is designed to generate said clocking signals at a plurality of clocking frequencies.

6. The instrument of claim 5, wherein said one voice module is designed to generate a plurality of tones having different frequencies and each of said clocking frequencies exceeds at least one tone frequency.

7. The instrument of claim 6, wherein each of said clocking frequencies is a multiple of at least one tone frequency.

8. The instrument of claim 1, wherein said one digital-analog converter unit has an output register corresponding to each of said analog outputs.

9. The instrument of claim 1, comprising a primary bus connecting said primary computer means with said one voice module, said primary bus including at least one conductor for the transmission of tone information, at least one conductor for the transmission of addressing signals, and at least one conductor for the transmission of control signals.

10. The instrument of claim 1, wherein said primary computer means comprises a primary microprocessor and a primary memory.

11. The instrument of claim 1, wherein said input means comprises a keyboard.

12. The instrument of claim 1, wherein said input means comprises digital and/or analog control elements.

13. The instrument of claim 1, said sequencer being designed to generate transfer signals for effecting transfer of said digital tone data to said one digital-analog converter unit; and wherein said one voice module comprises an access device for retrieving said digital tone data from said auxiliary computer means in response to said transfer signals.

14. The instrument of claim 1, said one digital-analog converter having a single channel; and wherein said one digital-analog converter unit comprises a multiplexer which is disposed between said one digital-analog converter and said analog outputs.

15. The instrument of claim 14, said sequencer being designed to generate control signals for effecting the appearance of said analog output signals at said analog outputs; and wherein said multiplexer is designed to establish communication between said channel and said analog outputs in response to said control signals.

16. The instrument of claim 1, wherein said one digital-analog converter has a channel corresponding to each of said analog outputs.

17. The instrument of claim 16, wherein said sequencer is designed to address said channels.

18. The instrument of claim 1, said sequencer being designed to generate transfer signals for effecting transfer of said digital tone data to said one digital-analog converter unit; and wherein said sequencer comprises a delay circuit for preventing the simultaneous generation of two transfer signals.

19. The instrument of claim 18, said one voice module having an intermediate memory corresponding to each of said analog outputs; and wherein each of said intermediate memories is arranged to temporarily store tone information between retrieval thereof from said auxiliary computer means and entry thereof into said analog outputs.

20. The instrument of claim 19, said sequencer being designed to generate control signals for effecting delivery of said tone information from said intermediate memories to said analog outputs; and wherein said sequencer and said clocking device are synchronized such that each of said control signals coincides with one of said clocking signals.

21. The instrument of claim 1, wherein said one digital-analog converter is designed to multiply tone signals corresponding to said digital tone data by at least one predetermined factor.

22. The instrument of claim 21, said auxiliary computer means being designed to generate digital data representing at least one envelope for said tones; and wherein said one voice module comprises an additional digital-analog converter unit which is connected with said auxiliary computer means and said one digital-analog converter unit, said additional digital-analog converter unit being arranged to receive said digital envelope data and to convert the same into analog envelope signals representing said one predetermined factor.

23. The instrument of claim 22, wherein said additional digital-analog converter unit comprises an additional digital-analog converter, and a plurality of registers arranged to receive said analog envelope signals, each of said registers being connected with a respective analog output.

24. The instrument of claim 23, said additional digital-analog converter having a single channel; and wherein said additional digital-analog converter unit comprises a multiplexer which is disposed between said additional digital-analog converter and said registers.

25. The instrument of claim 1, said clocking device having a predetermined number of clocking channels, and the number of said tone outputs being at least double said predetermined number; and wherein said one digital-analog converter unit comprises a plurality of analog outputs for each of said tone outputs and the clocking signals for each tone regulate at least two of the corresponding analog outputs.

26. The instrument of claim 1, said auxiliary computer means including an auxiliary computer and an auxiliary memory, and said one voice module comprising an auxiliary bus connecting said auxiliary memory with said auxiliary computer, said one digital-analog converter unit, said clocking device, said sequencer and said tone outputs; and further comprising a primary bus connecting said primary computer means with said one voice module, and a bus switch arranged to alternately establish communication between said primary bus and said auxiliary memory and between said auxiliary bus and said auxiliary memory.

27. The instrument of claim 26, wherein said bus switch is designed to permit bidirectional data flow between said auxiliary memory and said primary bus.

28. The instrument of claim 1, comprising audio conductor means connected with said tone outputs; and wherein each of said tone outputs comprises at least one output switch for selectively establishing communication between said analog outputs and said audio conductor means.

* * * * *

UNITED STATES PATENT AND TRADEMARK OFFICE

CERTIFICATE OF CORRECTION

PATENT NO. : 4,572,048

DATED : February 25, 1986

INVENTOR(S) : Reinhard FRANZ et al.

It is certified that error appears in the above-identified patent and that said Letters Patent are hereby corrected as shown below:

Foremost page, line [30], "P 33 18 669" should read 33 18 666

Col. 3, line 6, "hole" should read --whole--.
Col. 4, line 42, "output" should read --outputs--.
Col. 5, line 57, "rhythym" should read --rhythm--.
Col. 5, lines 66, 67 (twice) and 68, "manuel" should read --manual--.
Col. 6, line 47, "indicatpr" should read --indicator--.
Col. 6, lines 57, 58, 59, "rhythym" should read --rhythm--.
Col. 7, line 2, "rhythym" should read --rhythm--.
Col. 7, line 6, "mounding" should read --mounting--.
Col. 7, line 46, "time" should read --timer--.
Col. 7, line 55, "amd" should read --and--.
Col. 7, line 57, "sequence" should --sequencer--.
Col. 8, line 32, "Z" should read --ZS--.
Col. 8, line 34, "te" should read --the--.
Col. 8, line 43, "oftone" should read --of tone--.
Col. 10, line 5, "intermedoate" should read --intermediate--.
Col. 11, line 33, "E1,E2,D3" should read --E1,E2,E3--.
Col. 12, line 21, "connectedwith" should read --connected with--.

Signed and Sealed this

*Fifteenth* Day of *July 1986*

[SEAL]

*Attest:*

DONALD J. QUIGG

*Attesting Officer*

*Commissioner of Patents and Trademarks*